US010227686B2

(12) United States Patent
Arnold et al.

(10) Patent No.: US 10,227,686 B2
(45) Date of Patent: Mar. 12, 2019

(54) PRETREATING ZINC SURFACES PRIOR TO A PASSIVATING PROCESS

(71) Applicant: HENKEL AG & CO. KGaA, Duesseldorf (DE)

(72) Inventors: Andreas Arnold, Hilden (DE); Michael Wolpers, Erkrath (DE); Marcel Roth, Duesseldorf (DE); Uta Sundermeier, Leichlingen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 401 days.

(21) Appl. No.: 14/466,377

(22) Filed: Aug. 22, 2014

(65) Prior Publication Data

US 2014/0360630 A1 Dec. 11, 2014

Related U.S. Application Data

(63) Continuation of application No. PCT/EP2013/053522, filed on Feb. 22, 2013.

(30) Foreign Application Priority Data

Feb. 24, 2012 (DE) ..... 12156863

(51) Int. Cl.

| | |
|---|---|
| ***C23C 22/60*** | (2006.01) |
| ***C23C 22/00*** | (2006.01) |
| ***C23C 8/02*** | (2006.01) |
| ***C23C 22/18*** | (2006.01) |
| ***C23C 22/34*** | (2006.01) |
| ***C23C 22/73*** | (2006.01) |
| ***C23C 22/78*** | (2006.01) |
| ***C23C 22/83*** | (2006.01) |
| ***C23C 8/40*** | (2006.01) |

(52) U.S. Cl.

CPC ..... *C23C 8/02* (2013.01); *C23C 8/40* (2013.01); *C23C 22/00* (2013.01); *C23C 22/182* (2013.01); *C23C 22/34* (2013.01); *C23C 22/60* (2013.01); *C23C 22/73* (2013.01); *C23C 22/78* (2013.01); *C23C 22/83* (2013.01); *C23C 2222/00* (2013.01)

(58) Field of Classification Search

CPC ..... C23C 22/60–22/67; C23C 22/78

See application file for complete search history.

(56) References Cited

U.S. PATENT DOCUMENTS

| | | | |
|---|---|---|---|
| 3,444,007 | A | 5/1969 | Maurer et al. |
| 4,381,203 | A | 4/1983 | Reinhold |
| 5,294,266 | A | 3/1994 | Hauffe et al. |
| 6,346,295 | B1 | 2/2002 | Riesop et al. |
| 2010/0209732 | A1 | 8/2010 | Hackbarth et al. |
| 2012/0177946 | A1 | 7/2012 | Brouwer et al. |
| 2013/0202800 | A1 | 8/2013 | Brouwer et al. |

FOREIGN PATENT DOCUMENTS

| | | | | | |
|---|---|---|---|---|---|
| DE | 19733972 | A1 | | 2/1999 | |
| FR | 1496683 | | | 10/1966 | |
| FR | 1538274 | | | 10/1967 | |
| FR | 2352070 | A1 | | 12/1977 | |
| GB | 2178065 | | * | 2/1897 | ..... C23C 22/00 |
| WO | 2011090691 | A2 | | 7/2011 | |
| WO | WO 2011/098322 | | * | 8/2011 | ..... C23C 22/34 |

OTHER PUBLICATIONS

International Search Report for PCT/EP2013/053522, 2 pages.
European Search Report for EP 12 15 6863, 2 pages.

* cited by examiner

*Primary Examiner* — Lois L Zheng
(74) *Attorney, Agent, or Firm* — Mary K. Cameron

(57) ABSTRACT

The invention relates to a wet-chemical pretreatment of zinc surfaces prior to applying a corrosion-protection coating, which deposits a thin inorganic coating of oxide and/or metallic iron. An iron layer structure which is applied according to the invention, hereinafter referred to as ferrization, improves the achievable corrosion protection of wet-chemical conversion coatings on zinc surfaces. Furthermore, the ferrization process causes both a reduction of the contact corrosion of joined metal components which have zinc and iron surfaces as well as a reduction of corrosive coating migration on cut edges of galvanized steel strips with coating layer structures. In particular, the invention relates to an alkaline composition containing an iron ion source, a reducing agent based on oxoacids of nitrogen and phosphorus, and water-soluble organic carboxylic acids with an amino group at the α, β, or γ position with respect to the acid group and/or the water-soluble salts thereof.

22 Claims, No Drawings

PRETREATING ZINC SURFACES PRIOR TO A PASSIVATING PROCESS

The present invention relates to a wet-chemical pretreatment of zinc surfaces prior to the application of a corrosion-protective coating. The wet-chemical pretreatment brings about deposition of a thin inorganic coating that is made up substantially of oxidized and/or metallic iron. A covering layer of iron (hereinafter called "ferrization"), applied according to the present invention, results in an improvement in the corrosion protection achievable by wet-chemical conversion coatings, known in the existing art, on zinc surfaces. Ferrization furthermore brings about both a decrease in the contact corrosion of joined metallic components that have zinc and iron surfaces, and a decrease in corrosive paint infiltration at cut edges of galvanized strip steel having a paint layer structure. The invention relates in particular to an alkaline composition for ferrization, containing a source of iron ions, a reducing agent based on oxoacids of the elements nitrogen and phosphorus, and water-soluble organic carboxylic acids having an amino group in an α, β, or γ position with respect to the acid group, and/or water-soluble salts thereof.

A plurality of surface-finished steel materials are manufactured in the steel industry, and there is high demand for surface-finished embodiments to ensure the longest-lasting possible protection from corrosion. For the production of products such as automobile bodies, thin-sheet products in particular, made of different metallic materials and having different surface modifications, are further processed. For manufacture of the products, the surface-finished strip steels are cut out, reshaped, and joined to other metallic components by means of welding methods or adhesive bonding methods. A very wide variety of combinations of metallic base materials and surface materials is therefore implemented in these products. This manufacturing approach is very typical of body construction in the automotive industry, and is also referred to as "multi-metal" design. In body construction, it is principally galvanized strip steel that is further processed and joined, for example, to ungalvanized strip steel and/or strip aluminum. Auto bodies are thus made of a plurality of sheet-metal parts that are connected to one another by spot welds.

The metallic zinc coatings that are applied onto the steel strip, electrolytically or using the melt-immersion method, impart a cathodic protective effect that effectively prevents active dissolution of the more-noble core material as a result of mechanically caused injuries to the zinc coating. There is an economic advantage, however, to minimizing the overall corrosion rate, in order to maintain the cathodic protective effect of the less-noble metal coating for as long as possible. For this purpose, passivation layers that are of entirely inorganic or mixed organic/inorganic character, and/or organic primers, are applied by the strip-steel manufacturer or by the automobile manufacturer before painting in the paint shop of the body production line, as a barrier layer to further minimize corrosion; these also serve as a paint adhesion substrate for subsequent topcoating of the product.

Based on the many combinations common nowadays of metallic strip materials in a product, and the predominant use of surface-finished strip steels, particular corrosion phenomena occurring in the above-described production processes are cut-edge corrosion and bimetallic corrosion. At cut edges and at injuries to the zinc coating occurring due to processing or other influences, galvanic coupling between the core material and metallic coating results in local dissolution of the coating material, which can in turn result in corrosive infiltration of the organic barrier layers at these locations. The phenomenon of paint delamination, or "blistering," is therefore observed especially at cut edges of the panels. The same is true in principle for those locations on a component at which different metallic materials are directly connected to one another by joining techniques, and bimetallic corrosion is the consequence. The greater the difference in electrical potential between the metals in direct contact, the more pronounced the local activation of a "defect" of this kind (cut edge, injury to the metallic coating, spot-weld site), and thus the greater the corrosive paint delamination that proceeds from such defects. Correspondingly good results in terms of paint adhesion to cut edges are offered by strip steel having zinc coatings that are alloyed with more-noble metals, e.g. iron-alloyed zinc coatings ("galvannealed" steel).

An increasing trend among strip steel producers is to integrate into the strip facility, in addition to surface finishing with metallic coatings, the application of inorganic and/or organic protective layers, in particular the application of organic primers. In this context, it is of great economic advantage to the downstream processing industry to receive surface-finished strip steels that have little predisposition to cut-edge and bimetallic corrosion, so that good corrosion protection and good paint adhesion can be guaranteed even after fabrication of the products, which comprises stamping, cutting, shaping, and/or joining of strip steels followed by creation of a paint layer structure. A corresponding need exists in the downstream processing industry for pretreatment of the surfaces of products assembled from different metallic strip materials in such a way that the preferred delamination of subsequently applied paint layers at cut edges and bimetallic contacts is leveled out.

The existing art describes a variety of pretreatments that address the problem of edge protection. An essential strategy followed here is to improve paint adhesion of the organic barrier layer to the surface-finished strip steel. German Application DE 197 33 972 A1, for example, teaches a method for alkaline passivating pretreatment of galvanized and alloy-galvanized steel surfaces in strip facilities. Here the surface-finished steel strip is brought into contact with an alkaline treatment agent containing magnesium ions, iron (III) ions, and a complexing agent. At the defined pH of above 9.5, the zinc surface becomes passivated with formation of the corrosion-protective layer. According to the teaching of DE 197 33 972, a surface passivated in this manner already offers paint adhesion that is comparable to nickel- and cobalt-containing methods. In order to improve corrosion protection, this pretreatment can optionally be followed by further treatment steps, such as chromium-free post-passivation, before the paint system is applied.

DE 10 2010 001 686 A1 likewise pursues the passivation of galvanized steel surfaces, using alkaline compositions containing iron(III) ions, phosphate ions, and one or more complexing agents, in order to prepare the zinc surfaces for subsequent acidic passivation and a paint layer structure. Alkaline passivation here serves principally to improve the corrosion protection of chromium-free conversion coatings. The goal here is to achieve, with an alkaline cleaning step that brings about alkaline passivation and with a subsequent acidic passivation, a corrosion-protecting paint adhesion substrate comparable to zinc phosphating.

DE 10 2007 021 364 A1, in contrast, additionally pursues the objective of realizing, by means of electroless deposition of electropositive metal cations, a thin metallic covering layer on galvanized steel surfaces that, together with a subsequent passivation, is said to provide appreciably decreased corrosion at cut edges and bimetallic contacts of surface-finished strip steels that have been cut and joined. "Ferrization" and tinning of galvanized and alloy-galvanized strip steel is particularly recommended therein for improving edge protection. Acidic compositions containing iron ions, a complexing agent having oxygen ligands and/or nitrogen ligands, and phosphinic acid as a reducing agent, are preferably used for ferrization.

The object of the present invention is to further develop the ferrization of metal components that comprise zinc surfaces in such a way that, in interaction with subsequent wet-chemical conversion coatings, improved corrosion protection and paint adhesion priming on the zinc surfaces results; the intention in particular is to improve edge protection at cut edges of galvanized steel surfaces.

It has been possible, surprisingly, to demonstrate that when organic carboxylic acids having an amino group in an α, β, or γ position with respect to the acid group, and/or water-soluble salts thereof, are used in alkaline compositions for ferrization on zinc surfaces, extremely homogeneous thin covering layers made substantially of oxidized and/or metallic iron can be generated ("ferrization"), which layers, in interaction with a subsequent wet-chemical conversion treatment, provide improved corrosion protection especially at cut edges of galvanized steel surfaces, and an outstanding paint adhesion substrate.

The present invention therefore relates, in a first aspect, to an alkaline composition for the pretreatment of metallic components that comprise zinc surfaces, having a pH of at least 8.5, containing a) at least 0.01 WI iron ions,
b) one or more water-soluble organic carboxylic acids that comprise at least one amino group in an α, β, or γ position with respect to the acid group, as well as water-soluble salts thereof,
c) one or more oxoacids of phosphorus or nitrogen as well as water-soluble salts thereof, wherein at least one phosphorus atom or nitrogen atom is present in a moderate oxidation state.

"Water solubility" in the context of the present invention means that the solubility of the compound at a temperature of 25° C. and a pressure of 1 bar, in deionized water having a conductivity of less than 1 $\mu Scm^{-1}$, is greater than 1 g/l.

"Oxidation state" refers, according to the present invention, to the hypothetical charge of an atom which results from that number of electrons of the atom (compared with its nuclear charge number) which the corresponding atom hypothetically has if electrons are allocated on the basis of the electronegativity of the elements that form the molecule or salt; the element having the higher electronegativity is deemed to possess all the electrons that it shares with the elements of lower electronegativity, while electrons that are shared by identical elements are allocated half to the one atom and half to the other.

"Zinc surfaces" are considered according to the present invention to be not only surfaces of metallic zinc but also surfaces of galvanized steel and alloy-galvanized steel, if the zinc coverage is at least 5 $g/m^2$ based on the element zinc and the proportion of zinc in the zinc coating on the steel is at least 40 at %.

All compounds that release iron ions in water are possibilities as a source for iron ions dissolved in water. One or more water-soluble salts of di- or trivalent iron can preferably serve in a composition according to the present invention as a source of iron ions dissolved in water; the use of water-soluble salts of divalent iron ions, e.g. iron(II) nitrate or iron(II) sulfate, is preferred. Particularly suitable water-soluble compounds are the corresponding salts of α-hydroxycarboxylic acids having no more than 8 carbon atoms, which in turn are preferably selected from salts of polyhydroxymonocarboxylic acid, polyhydroxydicarboxylic acid having respectively at least 4 carbon atoms, tartronic acid, glycolic acid, lactic acid, and/or α-hydroxybutyric acid.

For sufficient rapid ferrization kinetics from aqueous solution, those compositions according to the present invention in which at least 0.1 g/l, preferably at least 1 g/l, particularly preferably at least 2 g/l of iron ions dissolved in the aqueous phase are contained, are preferred. In principle, additional quantities of dissolved iron ions result initially in a further increase in deposition kinetics, so that a different minimum quantity of iron ions in the composition according to the present invention is opportune depending on the application time span required by process engineering. If ferrization must be carried out within a few seconds for reasons of process engineering, as is the case e.g. when pretreating galvanized strip steel in a strip-coating facility, the composition then preferably contains at least 3 g/l iron ions. The upper limit for the quantity of iron ions is determined chiefly by the stability of the composition, and for a composition according to the present invention is preferably 50 g/l. The quantity indications regarding iron ions in a composition according to the present invention of course refer to the quantity of iron ions available for ferrization, and thus to the quantity of iron ions dissolved in the aqueous phase, for example in hydrated and/or complexed form. Iron ions in a form not available for ferrization, i.e. for example bound in undissolved iron salts, do not contribute to the proportion of iron ions in the composition according to the present invention.

In a preferred composition according to the present invention the molar ratio of iron ions to water-soluble organic carboxylic acids in accordance with component b) and water-soluble salts thereof is no greater than 2:1. Above this molar ratio, the accelerating effect of the organic carboxylic acids in accordance with component b) on ferrization already perceptibly decreases. Compositions according to the present invention in which the aforementioned molar ratio is no greater than 1:1 are therefore particularly preferred. Conversely, lowering the aforementioned molar ratio below 1:12 for the same quantity of iron ions, i.e. a further increase in the proportion of component b), produces no appreciable additional acceleration in the ferrization of zinc surfaces. Those compositions in which the molar ratio of iron ions to water-soluble organic carboxylic acids in accordance with component b) and water-soluble salts thereof is at least 1:12, preferably at least 1:8, are therefore preferred.

It has furthermore been found that specific organic carboxylic acids and/or salts thereof in accordance with component b) are particularly suitable, in compositions according to the present invention, for generating uniform and sufficient surface coverage of iron on zinc surfaces in a time interval typical for wet-chemical pretreatment. Those compositions in which the organic carboxylic acids and/or salts thereof in accordance with component b) are selected from water-soluble α-amino acids and water-soluble salts thereof, in particular from α-amino acids and water-soluble salts thereof which comprise, besides amino and carboxyl groups, exclusively hydroxyl groups and/or carboxylic acid amide groups, wherein the α-amino acids preferably comprise no more than 7 carbon atoms, are therefore preferred according to the present invention. In a preferred embodiment, a composition according to the present invention contains as component b) lysine, serine, threonine, alanine, glycine, aspartic acid, glutamic acid, glutamine, and/or water-soluble salts thereof, particularly preferably lysine, glycine, glutamic acid, glutamine, and/or water-soluble salts thereof, particularly preferably glycine and/or water-soluble salts thereof.

In this connection, an alkaline composition for the pretreatment of metallic surfaces that comprise zinc surfaces, for which the proportion of glycine and/or water-soluble salts thereof in terms of water-soluble organic carboxylic acids in accordance with component b) and/or water-soluble salts thereof is at least 50 wt %, particularly preferably at least 80 wt %, especially preferably at least 90 wt %, is preferred according to the present invention.

The oxoacids of phosphorus or nitrogen in accordance with component c) of the composition according to the present invention have reducing properties and thus bring about rapid and homogeneous ferrization of the zinc surfaces brought into contact with the composition according to the present invention. It is preferred in this context to use for ferrization as component c), those compositions according to the present invention which contain at least one oxoacid of phosphorus having at least one phosphorus atom in a moderate oxidation state, and water-soluble salts thereof.

In a preferred composition according to the present invention, for economic reasons the molar ratio of iron ions to oxoacids of phosphorus or nitrogen in accordance with component c) and water-soluble salts thereof is at least 1:10, preferably at least 1:6. On the other hand, the relative proportion of these compounds in accordance with component c) should be high enough for sufficient ferrization of the zinc surfaces. The aforesaid molar ratio in a composition according to the present invention is therefore preferably no greater than 3:1, particularly preferably no greater than 2:1. It is further preferred if the proportion of oxoacids of phosphorus in a composition according to the present invention, based on the total proportion of component c), is at least 50 mol %, particularly preferably at least 80 mol %.

In order to increase the deposition rate, the compounds in accordance with component c) of a composition according to the present invention are preferably selected from hyponitrous acid, hyponitric acid, nitrous acid, hypophosphoric acid, hypodiphosphonic acid, diphosphoric(III, V) acid, phosphoric acid, diphosphonic acid, and phosphinic acid, as well as water-soluble salts thereof; phosphinic acid and water-soluble salts thereof are particularly preferred.

For sufficient stability of the composition according to the present invention containing iron ions, it is furthermore advantageous to use specific complexing agents in order to suppress the precipitation of iron hydroxides and to maintain the highest possible proportion of iron ions in the aqueous phase in hydrated and/or complexed form.

The composition according to the present invention therefore preferably additionally contains, for stabilization, chelating complexing agents having oxygen and/or nitrogen ligands which are not water-soluble carboxylic acids in accordance with component b) of the compositions according to the present invention. Particularly preferred in this connection are compositions according to the present invention that contain as an additional component d) one or more such complexing agents that are selected from water-soluble α-hydroxycarboxylic acids that comprise at least one hydroxyl group and one carboxyl group and are not water-soluble organic carboxylic acids in accordance with component b), and from water-soluble salts thereof. The water-soluble α-hydroxycarboxylic acids in accordance with component d) furthermore preferably possess no more than 8 carbon atoms and are selected in particular from polyhydroxymonocarboxylic acids and/or polyhydroxydicarboxylic acids each having at least 4 carbon atoms, tartronic acid, glycolic acid, lactic acid, and/or α-hydroxybutyric acid, and from water-soluble salts thereof, very particularly preferably selected from lactic acid and/or 2,3,4,5,6-pentahydroxyhexanoic acid and from water-soluble salts thereof.

A particularly effective formulation of the composition according to the present invention having aforesaid complexing agents in accordance with component d) has a molar ratio of iron ions to water-soluble α-hydroxycarboxylic acids and water-soluble salts thereof of at least 1:4, preferably at least 1:3, but no greater than 2:1, preferably no greater than 1:1.

It is further possible to use, as an optional component e) in a composition according to the present invention, reducing accelerators that are known to the skilled artisan from the existing art of phosphating. These include hydrazine, hydroxylamine, nitroguanidine, N-methylmorpholine-N oxide, glucoheptonate, ascorbic acid, and reducing sugars.

The pH of the alkaline composition according to the present invention is preferably no higher than 11.0, particularly preferably no higher than 10.5, especially preferably no higher than 10.0.

The compositions according to the present invention can furthermore contain surface-active compounds, preferably nonionic surfactants, in order to bring about additional cleaning and activation of the metal surfaces, so that homogeneous ferrization on the zinc surfaces is additionally promoted. The nonionic surfactants are preferably selected from one or more ethoxylated and/or propoxylated C10 to C18 fatty alcohols having in total at least two but no more than 12 alkoxy groups, particularly preferably ethoxy and/or propoxy groups, which can be present partly end-capped with an alkyl residue, particularly preferably with a methyl, ethyl, propyl, butyl residue. For sufficient cleaning and activation of the metal surfaces, the proportion of nonionic surfactants in a composition according to the present invention is preferably at least 0.01 g/l, particularly preferably at least 0.1 g/l, wherein for economic reasons preferably no more than 10 g/l nonionic surfactants are contained.

In order to suppress precipitates, it is furthermore preferred that compositions according to the present invention not contain zinc ions in a quantity such that the ratio of the total molar proportion of zinc ions and iron ions in terms of the total molar proportion of water-soluble organic carboxylic acids in accordance with component b) and water-soluble organic α-hydroxycarboxylic acids in accordance with component d), and respective water-soluble salts thereof, is greater than 1:1, particularly preferably greater than 2:3.

The present invention is furthermore notable for the fact that no further heavy metals need to be added to a composition according to the present invention in order to furnish improved corrosion protection on the zinc surfaces as a ferrization constituent in interaction with a subsequent wet-chemical conversion treatment. A composition according to the present invention therefore preferably contains in total less than 50 ppm metal ions of the elements Ni, Co, Mo, Cr, Ce, V, and/or Mn, particularly preferably less than 10 ppm in each case, especially preferably less than 1 ppm of each of these elements.

The composition according to the present invention furthermore preferably contains less than 1 g/l water-soluble or water-dispersible organic polymers, since carryover of polymeric constituents from the ferrization pretreatment into subsequent baths for wet-chemical conversion treatment can have a disadvantageous effect on formation of the conversion layer. "Water-soluble or water-dispersible polymers"

are understood according to the present invention as organic compounds that remain in the retentate upon ultrafiltration with a nominal molecular weight cutoff (NMWC) of 10,000 u.

The present invention also encompasses a concentrate that, by dilution by a factor of 5 to 50, yields the above-described alkaline composition. A concentrate according to the present invention has a pH above 8.5 and preferably contains a) 5 to 100 g/l iron ions, b) 15 to 200 g/l water-soluble organic carboxylic acids that comprise at least one amino group in an α, β, or γ position with respect to the acid group, as well as water-soluble salts thereof, c) 20 to 300 g/l oxoacids of phosphorus or nitrogen as well as water-soluble salts thereof, wherein at least one phosphorus atom or nitrogen atom is present in a moderate oxidation state.

In a second aspect, the present invention relates to a method for the pretreatment ("ferrization") of metallic components that comprise zinc surfaces, wherein at least the zinc surfaces of the component i) optionally are firstly cleaned with an alkaline cleaner and degreased, ii) are brought into contact with an above-described alkaline composition according to the present invention, and iii) are then subjected to a passivating wet-chemical conversion treatment.

In the method according to the present invention, in step ii) firstly a covering layer made substantially of oxidized and/or metallic iron is generated on the zinc surfaces ("ferrization"). An inorganic layer of this kind is not detectable on the remaining surfaces of the metallic components, which can be e.g. surfaces of iron, steel, and/or aluminum. In the method according to the present invention in which ferrization is followed by a passivating wet-chemical conversion treatment, specific deposition of the passive layer on the zinc surfaces results, surprisingly, in an appreciable improvement in paint adhesion properties on said surfaces, and effectively suppresses corrosion at cut edges of galvanized steel and contact corrosion of ferrous metals joined to the zinc surfaces. A passivating wet-chemical conversion treatment is a feature that is usual in the steel industry and automotive industry for pretreatment prior to application of an organic topcoat structure In a preferred embodiment of the method according to the present invention, the metallic component comprises galvanized steel surfaces. The method is particularly advantageous in the treatment of galvanized strip steel because it provides outstanding edge-corrosion protection, and of components made of metallic components, assembled and/or fitted together in a mixed design, made of galvanized steel, iron, and/or steel and optionally aluminum, because it greatly reduces contact corrosion.

The alkaline cleaning step I) in the method according to the present invention is optional, and is necessary when the surfaces made of zinc exhibit contaminants in the form of salts and greases, for example drawing grease and corrosion-protection oils.

Ferrization is accomplished in step ii) of the method according to the present invention; the manner in which contact is established with the alkaline composition according to the present invention is not limited, in terms of process engineering, to a specific method. Preferably the zinc surfaces are brought into contact with the composition according to the present invention for ferrization by immersion or spraying.

In a preferred embodiment of the method, the metallic component is brought into contact with an alkaline composition according to the present invention for at least 3 seconds but no more than 4 minutes, at a temperature of at least 30° C., particularly preferably at least 40° C., but no more than 70° C., particularly preferably no more than 60° C. As already discussed, the compositions according to the present invention cause ferrization of the zinc surfaces. The ferrization occurs in self-limiting fashion, i.e. the rate of iron deposition decreases with increasing ferrization of the zinc surfaces. The preferred treatment times or contact times in the method according to the present invention should be selected so that the surface coverage or iron is at least 20 $mg/m^2$ based on the element iron. The treatment times and contact times for achieving a minimum surface coverage of this kind vary depending on the manner of application, and depend in particular on the flow of aqueous fluid acting on the metal surface to be treated. Ferrization will thus form more quickly in methods in which the composition is applied by spraying than in dip applications. Regardless of the manner of application, surface coverages of iron appreciably greater than 300 $mg/m^2$, based on the element iron, are not achieved with the compositions according to the present invention because the ferrization is self-limiting.

For sufficient layer formation and optimum edge protection when treating galvanized steel surfaces, surface coverages of iron of preferably at least 20 $mg/m^2$, particularly preferably at least 50 $mg/m^2$, especially preferably more than 100 $mg/m^2$, but preferably no more than 250 $mg/m^2$, based in each case on the element iron, should be present immediately after ferrization in step ii), with or without a subsequent rinsing step.

The surface coverage of iron on the zinc surfaces can be ascertained, after dissolution of the coating, by means of a spectroscopic method that is described in the Examples portion of the present invention.

Ferrization in step ii) of the method according to the present invention is preferably carried out in electroless fashion, i.e. without application of an external voltage source to the metallic component.

In step iii) of the method according to the present invention a passivating wet-chemical conversion treatment occurs subsequently to step ii), with or without an interposed rinsing step. A "wet-chemical conversion treatment" is understood according to the present invention to mean bringing at least the zinc surfaces of the metal component into contact with an aqueous composition that generates a passivating and substantially inorganic conversion coating on the treated zinc surfaces. A conversion coating in this context is any organic coating on the metallic zinc substrate which does not represent an oxide- or hydroxide-type coating, and the principal cationogenic constituent of which is zinc ions. A conversion coating can therefore be a zinc phosphate layer.

In a preferred embodiment of the method according to the present invention, a passivating wet-chemical conversion is accomplished in step iii) by establishing contact with an acidic aqueous composition that contains in total at least 5 ppm but in total no more than 1500 ppm water-soluble inorganic compounds of the elements Zr, Ti, Si, and/or Hf, based on the aforesaid elements, and preferably water-soluble inorganic compounds that release fluoride ions, for example fluoro complexes, hydrofluoric acid, and/or metal fluorides.

In this connection, in step iii) of the method according to the present invention those acidic aqueous compositions which contain, as water-soluble compounds of the elements zirconium, titanium, and/or hafnium, only water-soluble compounds of the elements zirconium and/or titanium, particularly preferably water-soluble compounds of the element zirconium are preferred. Both compounds that dissociate in aqueous solution into anions of fluoro complexes of the elements titanium and/or zirconium, for example $H_2ZrFG$, $K_2ZrF_6$, $Na_2ZrF_6$, and $(NH_4)_2ZrF_6$ and the analogous titanium compounds, and fluorine-free compounds of the elements zirconium and/or titanium, for example $(NH_4)_2Zr(OH)_2(CO_3)_2$ or $TiO(SO_4)$, can be used in acidic aqueous compositions in step iii) of the method according to the present invention as water-soluble compounds of the elements zirconium and/or titanium.

In step iii) of the preferred method according to the present invention, the acidic aqueous composition that contains in total at least 5 ppm but in total no more than 1500 ppm water-soluble inorganic compounds of the elements Zr, Ti, Si, and/or Hf, based on the aforesaid elements, is preferably chromium-free, i.e. it contains less than 10 ppm, preferably less than 1 ppm chromium, in particular no chromium(VI).

In an alternatively preferred embodiment of the method according to the present invention a zinc phosphating step occurs in step iii), wherein in the zinc phosphating step the presence of the heavy metals Ni and/or Cu can be largely omitted due to the previous ferrization of the zinc surfaces of the metallic component in step ii). Ferrization of the zinc surfaces thus yields the unexpected advantage, for subsequent zinc phosphating, that the resulting corrosion protection and paint adhesion for zinc surfaces phosphated in this manner is comparable to the zinc phosphating of iron or steel surfaces.

In a preferred embodiment of the method according to the present invention the passivating wet-chemical conversion treatment in step iii) consists in the fact that the galvanized steel surfaces pretreated in step ii) are brought into contact with an acidic aqueous composition that has a pH in the range from 2.5 to 3.6 and contains a) 0.2 to 3.0 g/L zinc (II) ions,
b) 5.0 to 30 g/L phosphate ions, calculated as $P_2O_5$, and
c) preferably less than 0.1 g/L in each case of ionic compounds of the metals nickel and cobalt, based in each case on the metallic element.

The pretreated metallic components that have surfaces made of zinc and proceed directly from a method according to the present invention are then, with or without an interposed rinsing and/or drying step, preferably provided with an organic surface layer. The first surface layer in the context of the pretreatment of previously cut, shaped, and joined components is usually an electrocoating paint, particularly preferably a cathodic dipcoating paint. In the context of corrosion-protecting or decorative coating of galvanized strip steel, in contrast, organic primer coatings are preferably applied as a first organic surface layer subsequently to the method according to the present invention.

The metallic components that have surfaces made of zinc and are treated in a method according to the present invention are utilized in body construction in automotive production, in shipbuilding, in the building trades, and for the manufacture of white goods.

EXEMPLIFYING EMBODIMENTS

The influence of various α-amino acids with regard to ferrization homogeneity, after compositions according to the present invention are brought into contact with electrolytically galvanized steel by immersion, is reproduced in Table 1.

Firstly, with all compositions according to the present invention (C1 to C4) thin coatings of oxidized and/or metallic iron are obtained on the zinc surfaces ("ferrization"), although particularly homogeneous coatings are formed especially by compositions according to the present invention (C1; C5) containing glycine.

TABLE 1

Alkaline compositions according to the present invention for ferrization

| | Component: | C1 | C2 | C3 | C4 | C5 |
|---|---|---|---|---|---|---|
| a) | Iron(II) gluconate | 12.50 | 12.50 | 12.50 | 12.50 | 1.25 |
| | Iron(II) lactate | 18.75 | 18.75 | 18.75 | 18.75 | 1.87 |
| b) | Glycine | 45.00 | — | — | — | 4.50 |
| | L-Glutamine | — | 87.61 | — | — | — |
| | L-Glutamic acid | — | — | 88.20 | — | — |
| | L-Lysine | — | — | — | 87.63 | — |
| c) | $NaH_2PO_2$ | 45.00 | 45.00 | 45.00 | 45.00 | 4.50 |
| | NaOH, 50 wt % | 25.00 | 32.60 | 76.70 | 25.00 | 2.50 |
| | Water | 853.75 | 803.54 | 758.85 | 811.12 | 985.38 |
| | pH | 9.0 | 9.0 | 9.0 | 9.0 | 9.0 |
| Method parameters: | | C1 | C2 | C3 | C4 | C5 |
| Dip application [1] | | 10 s @ 50° C. | 10 s @ 50° C. | 10 s @ 50° C. | 10 s @ 50° C. | 60 s @ 50° C. |
| Visual score [2] | | ++ | + | + | ○ | ++ |

[1] on electrolytically galvanized steel panel (Gardobond ® MBZE7)
[2] in terms of ferrization homogeneity:
++ homogeneous dark gray coating
+ almost complete coverage with dark gray coating
○ incomplete coverage with dark gray to brownish coating
– inhomogeneous coverage with predominantly light gray to brownish coating The concentration of active components in a composition according to the present invention has a direct effect on deposition rate, so that diluted compositions need to be brought into contact with the galvanized steel surface for a correspondingly longer time in order to obtain a homogeneously coated zinc surface (see C1 compared with C5).

The effect of ferrization in the context of the use of compositions according to the present invention with reference to process chains for corrosion-protective pretreatment of zinc surfaces, will be presented below. Table 2 indicates the corrosive infiltration of a dipcoating paint on electrolytically galvanized steel after the respective process chain for corrosion-protective pretreatment, in the alternating climate test and stone impact test.

The individual method steps of the process chains listed in Table 2 for corrosion-protective treatment of individual galvanized steel panels (Gardobond® MBZE7) are shown below:

A. Alkaline cleaning (pH 11):
3 wt % Ridoline® 1574A (Henkel Co.);
0.4 wt % Ridosol® 1270 (Henkel Co.)
Treatment time at 60° C.: 180 seconds.
B. Rinse with deionized water ($\kappa<1$ μS $cm^{-1}$)
C. Ferrization using a composition according to Table 1:
Treatment time at 50° C.: 60 seconds
D. Activation:
0.1 wt % Fixodine® 50CF (Henkel Co.)
Remainder deionized water ($\kappa<1$ μS $cm^{-1}$)
Treatment time at 20° C.: 60 seconds
E1. Acidic passivation:
0.34 g/l $H_2ZrF_6$
0.12 g/L ammonium bifluoride
0.08 g/L $Cu(NO_3)_2.3H_2O$ Remainder deionized water ($\kappa$<1 $\mu$S $cm^{-1}$)
pH: 4
Treatment time at 30° C.: 120 seconds E2. Nickel-free phosphating:
0.13 wt % zinc
0.09 wt % manganese
0.12 wt % nitrate
1.63 wt % phosphate
0.25 wt % hydroxylamine sulfate
0.02 wt % ammonium bifluoride
0.10 wt % $H_2SiF_6$
Remainder deionized water ($\kappa$<1 $\mu$S $cm^{-1}$)
Free fluoride: 40 mg/L
Free acid: 1.3 points (pH 3.6)
Total acid: 26 points (pH 8.5)
Treatment time at 50° C.: 180 seconds E3. Nickel-containing phosphating (trication phosphating):
0.13 wt % zinc
0.09 wt % manganese
0.10 wt % nickel
0.32 wt % nitrate
1.63 wt % phosphate
0.25 wt % hydroxylamine sulfate
0.02 wt % ammonium bifluoride
0.10 wt % $H_2SiF_6$
Remainder deionized water ($\kappa$<1 $\mu$S $cm^{-1}$)
Free fluoride: 40 mg/L
Free acid: 1.3 points (pH 3.6)
Total acid: 26.5 points (pH 8.5)
Treatment time at 50° C.: 180 seconds F Paint structure: EV2007 (PPG Co.): layer thickness 17 to 19 μm It is clearly evident from Table 2 that in a process chain according to the present invention that wet-chemical conversion by means of aqueous zirconium-containing passivation solutions (B1), ferrization produces improved corrosion protection as compared with an analogous process chain in which ferrization is omitted (V1).

The same can be noted for the improvement in corrosion protection of those galvanized steel panels which were subjected to nickel-free zinc phosphating. Here as well, prior ferrization (B2) results in substantially improved corrosion values as compared with zinc phosphating alone (B2). The corrosion results obtained with ferrization (B2) are even improved as compared with trication phosphating (V3), often used in the existing art for corrosion-protective pretreatment of components fabricated with mixed materials.

TABLE 2

Various method sequences for corrosion-protective treatment of electrolytically galvanized strip steel (Gardobond ® MBZE7, Chemetall Co.), and results in terms of scratch infiltration and the stone impact test

| Method sequence | Scratch infiltration[1] (mm) | K value[1] | Surface coverage[2] of $ZnPO_4$ ($g/m^2$) | Surface coverage[3] of iron ($mg/m^2$) |
|---|---|---|---|---|
| B1 A-B-C5-B-E1-B-F | 2.0 | 3.5 | — | 193 |
| B2 A-B-C5-B-D-E2-B-F | 1.9 | 2.5 | 2.6 | 202 |
| V1 A-B-E1-B-F | 4.0 | 4.5 | — | — |
| V2 A-B-D-E2-B-F | 3.9 | 5.0 | 2.9 | — |
| V3 A-B-D-E3-B-F | 2.3 | 3.5 | 3.0 | — |

[1]Stone impact and scratch infiltration per DIN EN ISO 20567-1 after exposure using VDA 621-415 alternating climate test (10 weeks)
[2]Determined by dissolving off the zinc phosphate layer with aqueous 5-wt % $CrO_3$ that was brought into contact with a defined area of the galvanized panel immediately after method step E2 or E3 at 25° C. for 5 minutes, and determining the phosphorus content in the same pickling solution using ICP-OES. The coating weight of zinc phosphate is determined by multiplying the quantity of phosphorus per unit area by a factor of 6.23.
[3]Quantitative determination of the quantity of iron(III) ions by UV photometry (Photo-Flex ®, WTW company) in 300 μl sample volume of a 5-wt % nitric acid solution that was pipetted onto a defined area (1.33 $cm^2$) of the galvanized panel immediately after method step C using a measurement cell ring (Helmut Fischer company) and taken up with the same pipette after 30 seconds of exposure time at a temperature of 25° C. and transferred into the UV measurement cuvette, in which 5 ml of a 1.0% sodium thiocyanate solution had been prepared, for determination of absorption at a wavelength of 517 nm and a temperature of 25° C. Calibration was effected using a two-point method, by determining absorption values of identical volumes (300 μl) of two standard solutions of iron(III) nitrate in 5-wt % nitric acid, which were transferred into the measurement cuvette containing 5 ml of a 1.0% sodium thiocyanate solution for determination of absorption values at 25° C.

What is claimed is:

1. A method for pretreating galvanized steel surfaces, wherein the galvanized steel surfaces
i) optionally are firstly cleaned with an alkaline cleaner and degreased,
ii) are brought into contact with an alkaline composition comprising:
a) at least 3.0 g/l iron ions,
b) one or more water-soluble organic carboxylic acids that comprise a carboxyl group and at least one amino group in an α, β, or γ position with respect to the carboxyl group, as well as water-soluble salts thereof,
c) a reducing agent based on one or more oxoacids of phosphorus or nitrogen as well as water-soluble salts thereof, wherein at least one phosphorus atom or nitrogen atom is present in a moderate oxidation state;
wherein the alkaline aqueous composition has a pH of at least 8.5 and no higher than 10.0;
treatment time and temperature being selected such that a covering layer made substantially of oxidized and/or metallic iron is generated on the galvanized steel surfaces;
and
iii) after step ii) are subjected to a passivating wet-chemical conversion treatment that contains no chromium(VI).

2. The method according to claim 1, wherein step ii) occurs in electroless fashion.

3. The method according to claim 1, further comprising selecting a contact temperature and contact time for step ii) such that surface coverage of iron on the galvanized steel surfaces is at least 20 $mg/m^2$ and no more than 250 $mg/m^2$, based on the element iron.

4. The method according to claim 1, wherein the passivating wet-chemical conversion treatment of step iii) comprises bringing the galvanized steel surfaces pretreated in step ii) into contact with an acidic aqueous composition that contains in total at least 5 ppm but in total no more than 1500ppm water-soluble inorganic compounds of elements selected from Zr, Ti, Si, Hf and mixtures thereof, based on said elements.

5. The method according to claim 1, wherein the passivating wet-chemical conversion treatment of step iii) comprises bringing the galvanized steel surfaces pretreated in step ii) into contact with an acidic aqueous composition that has a pH in the range from 2.5 to 3.6 and comprises:

a) 0.2 to 3.0 g/L zinc(II) ions, b) 5.0 to 30 g/L phosphate ions, calculated as $P_2O_5$, and c) less than 0.1 g/L in each case of ionic compounds of a metallic element selected from nickel and cobalt, based in each case on the metallic element.

6. The method according to claim 1, wherein the iron ions in the alkaline composition of step ii) are present in an amount of in total no more than 10 g/l.

7. The method according to claim 1, wherein the alkaline composition of step ii) has a molar ratio of the iron ions to component b) that is equal to at least 1:12, but is no greater than 2:1.

8. The method according to claim 1, wherein the one or more water-soluble organic carboxylic acids in accordance with component b) of the alkaline composition of step ii) are selected from α-amino acids.

9. The method according to claim 8, wherein the α-amino acids comprise, in addition to amino and carboxyl groups, exclusively hydroxyl groups.

10. The method according to claim 9, wherein the α-amino acids are selected from lysine, serine, threonine, alanine, glycine, aspartic acid, glutamic acid and mixtures thereof.

11. The method according to claim 1, wherein the alkaline composition of step ii) has a molar ratio of the iron ions to component c) of at least 1:10, but no greater than 3:1.

12. The method according to claim 1, wherein the oxoacids of phosphorus or nitrogen in accordance with component c) of the alkaline composition of step ii) are selected from hyponitrous acid, hyponitric acid, nitrous acid, hypophosphoric acid, hypodiphosphonic acid, diphosphoric(III, V) acid, phosphonic acid, diphosphonic acid, phosphinic acid, water-soluble salts of said oxoacids and mixtures thereof.

13. The method according to claim 1, wherein the alkaline composition of step ii) further comprises component d) one or more water-soluble α-hydroxycarboxylic acids that comprise at least one hydroxyl group and one carboxyl group and/or salts thereof, different from component b).

14. The method according to claim 13, wherein the alkaline composition of step ii) has a molar ratio of iron ions to component d) that is equal to at least 1:4, but is no greater than 2:1.

15. The method according to claim 13, wherein the water-soluble α-hydroxycarboxylic acids in accordance with component d) of the alkaline composition of step ii) comprise no more than 8 carbon atoms.

16. The method according to claim 13, wherein the water-soluble α-hydroxycarboxylic acids in accordance with component d) of the alkaline composition of step ii) are selected from the group consisting of polyhydroxymonocarboxylic acids having at least 4 carbon atoms, polyhydroxydicarboxylic acids having at least 4 carbon atoms, tartronic acid, glycolic acid, lactic acid, α-hydroxybutyric acid and mixtures thereof.

17. The method according to claim 1 wherein in the alkaline composition of step ii), zinc ions are not contained in a quantity that produces a ratio of total molar proportion of zinc ions and iron ions in terms of total molar proportion of component b) and component d), that is greater than 1 : 1.

18. The method according to claim 3, wherein the contact time for step ii) ranges from about 3 seconds to no more than about 4 minutes and the contact temperature for step ii) ranges from at least about 30° C. to no more than about 70° C.

19. A method for pretreating galvanized steel surfaces, wherein the galvanized steel surfaces are zinc surfaces consisting of metallic zinc and/or iron-alloyed zinc, and i) optionally are firstly cleaned with an alkaline cleaner and degreased, ii) are contacted with an alkaline aqueous composition comprising:

a) at least 0.01 g/l iron ions, b) one or more water-soluble organic carboxylic acids that comprise a carboxyl group and an $NH_2$ group in an α position with respect to the carboxyl group, as well as water-soluble salts thereof;

c) a reducing agent based on one or more oxoacids of phosphorus or nitrogen as well as water-soluble salts thereof, wherein at least one phosphorus atom or nitrogen atom is present in a moderate oxidation state;

wherein the alkaline aqueous composition has a pH of at least 8.5; and iii) after step ii) are subjected to a passivating wet-chemical conversion treatment.

20. The method according to claim 19, wherein the one or more water-soluble organic carboxylic acids are α-amino acids comprising, in addition to the carboxyl groups and the $NH_2$ group in an αposition with respect to the carboxyl groups, exclusively hydroxyl groups.

21. The method according to claim 20, wherein the α-amino acids are selected from lysine, serine, threonine, alanine, glycine, aspartic acid, glutamic acid and mixtures thereof.

22. A method for pretreating galvanized steel surfaces, comprising:

i) optionally cleaning and degreasing the galvanized steel surfaces with an alkaline cleaner;

ii) contacting the galvanized steel surfaces with an alkaline aqueous solution comprising:

a) at least 0.01 g/l iron ions, b) one or more water-soluble organic carboxylic acids that comprise a carboxyl group and at least one amino group in an α, β, or γ position with respect to the carboxyl group, as well as water-soluble salts thereof, c) a reducing agent in the form of one or more oxoacids of phosphorus as well as water-soluble salts thereof, wherein at least one phosphorus atom is present in a moderate oxidation state;

wherein the alkaline aqueous solution has a pH of at least 8.5;

wherein the alkaline aqueous solution of step ii), comprises zinc ions, with the proviso that the zinc ions are not contained in the aqueous solution in a quantity that produces a ratio of total molar proportion of zinc ions and iron ions in terms of total molar proportion of component b) and component d), that is greater than 1:1;

and iii) after step ii) are subjected to a passivating wet-chemical conversion treatment.

* * * * *